US005591391A

United States Patent [19]

Igarashi et al.

[11] Patent Number: 5,591,391

[45] Date of Patent: Jan. 7, 1997

[54] HIGH CHROMIUM FERRITIC HEAT-RESISTANT STEEL

[75] Inventors: Masaaki Igarashi, Hyogo; Hiroyuki Senba, Nishinomiya; Kaori Miyata, Amagasaki, all of Japan

[73] Assignee: Sumitomo Metal Industries, Ltd., Osaka, Japan

[21] Appl. No.: 529,395

[22] Filed: Sep. 18, 1995

[30] Foreign Application Priority Data

Sep. 20, 1994 [JP] Japan ..... 6-224531

[51] Int. Cl.[6] ..... C22C 38/30; C22C 38/52

[52] U.S. Cl. ..... 420/38; 420/37

[58] Field of Search ..... 420/37, 38, 40

[56] References Cited

U.S. PATENT DOCUMENTS

| | | |
|---|---|---|
| 2,848,323 | 8/1958 | Harris et al. . |
| 3,663,208 | 5/1972 | Kirby et al. . |
| 5,069,870 | 3/1991 | Iseda et al. . |

FOREIGN PATENT DOCUMENTS

| | | |
|---|---|---|
| 0411931A1 | 6/1991 | European Pat. Off. . |
| 41-48817 | 7/1966 | Japan . |
| 55-54550 | 4/1980 | Japan . |
| 55-110758 | 8/1980 | Japan . |
| 57-36341 | 8/1982 | Japan . |
| 58-181849 | 10/1983 | Japan . |
| 59-211553 | 11/1984 | Japan . |
| 61-110753 | 5/1986 | Japan . |
| 62-8502 | 2/1987 | Japan . |
| 62-12304 | 3/1987 | Japan . |
| 62-89842 | 4/1987 | Japan . |
| 62-297436 | 12/1987 | Japan . |
| 63-65059 | 3/1988 | Japan . |
| 63-76854 | 4/1988 | Japan . |
| 2-232345 | 9/1990 | Japan . |
| 2-294452 | 12/1990 | Japan . |
| 2-294450 | 12/1990 | Japan . |
| 3-53047 | 3/1991 | Japan . |
| 3-97832 | 4/1991 | Japan . |
| 4-371552 | 12/1992 | Japan . |
| 4-371551 | 12/1992 | Japan . |
| 5-17850 | 1/1993 | Japan . |
| 5-263196 | 10/1993 | Japan . |
| 5-311346 | 11/1993 | Japan . |
| 5-311345 | 11/1993 | Japan . |
| 5-311344 | 11/1993 | Japan . |
| 5-311343 | 11/1993 | Japan . |
| 5-311342 | 11/1993 | Japan . |
| 6-65689 | 3/1994 | Japan . |
| 6-293940 | 10/1994 | Japan . |
| 7-62497 | 3/1995 | Japan . |
| WO94/08063 | 4/1994 | WIPO . |

OTHER PUBLICATIONS 678,616 Sep. 1952 Alloy Research.

*Primary Examiner*—Deborah Yee

*Attorney, Agent, or Firm*—Burns, Doane, Swecker & Mathis, LLP

[57] ABSTRACT

The present invention discloses high chromium ferritic heat-resistant steel which has remarkable properties that the base metal and welded joints of the steel both exhibit excellent long term creep strength at elevated temperatures over 600° C. excellent resistance to steam oxidation, and excellent toughness at room temperatures. The chemical composition of main elements of the steel of the invention is as follows:

| | |
|---|---|
| Cr: 8.0 to 13.0%, | W: 1.5 to 4.0%, |
| Co: 2.5 to 8.0%, | Ta: 0.01 to 0.50%, |
| Nd: 0.001 to 0.24%, | |

wherein % means % by weight.

The steel of the present invention further encompasses steels which contain, in addition to the above essential chemical composition, at least one element selected from the group consisting of Sc, Y, La, and Ce, or at least one element selected from the group consisting of Hf, Ti, and Zr, or at least one element from each of the two groups at the same time. When creep property and toughness are required for welded joints, the amounts of W, Mo, Ta, Nb, and B are selected properly.

16 Claims, No Drawings

HIGH CHROMIUM FERRITIC HEAT-RESISTANT STEEL

BACKGROUND OF THE INVENTION

1. Field of the Invention

The present invention relates to a high chromium ferritic heat-resistant steel. The heat resistant steel of the present invention has excellent long-term creep strength at elevated temperature, high resistance to steam oxidation, and prominent toughness at room temperature. Moreover, the welded joints including heat affected zone (HAZ) have also excellent long-term creep strength and prominent toughness. Therefore, the heat resistant steel of the present invention is suitable for use as a material of equipments operated under conditions of high temperature and high pressure, such as boilers, nuclear power plants, and chemical engineering facilities. More particularly, the heat resistant steel of the invention is advantageously used for making steel tubes for heat exchangers, steel plates for pressure vessels, and turbine parts.

2. Description of the Related Art

Equipments such as boilers, nuclear power plants, and chemical engineering facilities are used under conditions of high temperature and high pressure for long periods. Therefore, heat-resistant steels used for these equipments must have sufficient strength, anti-corrosion properties, and resistance to oxidation at elevated temperature, as well as toughness at room temperature. Moreover, in view of the fact that these steels are also used as structural steels fabricated by welding, the welded joints of the steels must have sufficient long-term creep strength at elevated temperatures and toughness.

For these uses, austenitic stainless steels (such as JIS-SUS321H and JIS-SUS347H steels), low-alloy steels (such as JIS-STBA24 (2¼ Cr-1Mo)), and high chromium ferritic steels of a 9–12 Cr series (such as JIS-STBA26 (9Cr-1 Mo)) have heretofore been used. Among them, high chromium ferritic steels are superior to low-alloy steels in terms of strength and anti-corrosion properties in a temperature range from 500° to 650° C. Moreover, high chromium ferritic steels have advantages that they are less expensive than austenitic stainless steels, that they have excellent resistance to thermal fatigue and scale exfoliation due to their high heat conductivities and small heat expansion coefficients. Another notable advantage is that they do not cause stress corrosion cracks. Due to the above-mentioned excellent properties, high chromium ferritic heat-resistant steels have wide applications.

In recent thermal power plants, steam conditions in boilers are becoming higher temperatures and higher pressures in order to achieve high thermal efficiency. In fact, there is a plan to operate thermal power plants under ultra-super critical conditions of 650° C. and 350 atm in the future rather than current super critical conditions of 538° C. and 246 atm. As steam conditions become severe, greater performance is required for steel tubes for boilers. Thus, there is a situation where previous high chromium ferritic steels can no longer satisfactorily meet the above-described requirements due to the shortage of long-term creep strength at elevated temperatures and resistance to oxidation, and particularly resistance to steam oxidation. In this connection, steam oxidation is a phenomenon which occurs on the inside surface of steel tubes of boilers that are exposed to steam of high temperature and high pressure. When scales are generated as a result of oxidation, they tend to come off as the boiler temperature changes. Since exfoliated scales cause severe problems such as plugging of steel tubes, prevention of steam oxidation is an important technical subject.

Austenitic stainless steels have properties that meet the above-described severe requirements. However, their high price limits their use in commercial facilities. Thus, efforts are directed to improve properties of high chromium ferritic steels that are less expensive than austenitic stainless steels and to expand the range of their applications.

As an improvement of the properties of high chromium ferritic steels, a heat-resistant steel containing tungsten into conventional high chromium ferritic steels was developed. For example. Japanese Patent Application Laid-open (kokai) No. 3-97832 discloses a high chromium ferritic steel which has an increased W content compared with conventional ones, and also contains Cu so as to improve resistance to oxidation at high temperatures. Japanese Patent Application Laid-open (kokai) Nos. 4-371551 and 4-371552 disclose high chromium ferritic steels whose strength at elevated temperatures and toughness are enhanced by containing W and Mo with a properly selected ratio between them, and by also containing Co and B.

These high chromium ferritic steels contain a great amount of W, and therefore, they have excellent long term creep strength at elevated temperatures. W, however, is also a ferrite-forming element as are Mo and Cr, a large content thereof inevitably produces δ-ferrite in steel. Consequently, a drawback is caused in which the toughness of the high chromium ferritic steel decreases.

In order to effectively prevent a decrease in toughness, high chromium ferritic steels are processed to have a single phase of martensite. Japanese Patent Application Laid-open (kokai) No. 5-263196, following this approach, discloses a heat-resistant steel having a single phase of martensite obtained by reducing the Cr content. Moreover, high chromium ferritic steels with enhanced toughness have been obtained by an addition of austenite-forming elements, e.g., Ni, Cu, Co, etc., into high chromium ferritic steels (Japanese Patent Application Laid-open (kokai) Nos. 5-311342, 5-311343, 5-311344, 5-311345, and 5-311346).

The high chromium ferritic steels disclosed in Japanese Patent Application Laid-open (kokai) No. 5-263196 have the drawback that they have poor resistance to steam oxidation since Mo, Ni, etc. distract a dense and stable scale layer of the corundum type $Cr_2O_3$ formed on steel surface. Moreover, the high chromium ferritic steels disclosed, for example, in Japanese Patent Application Laid-open (kokai) No. 5-311342 contain Ni, Cu, etc. abundantly, and therefore, they have low $A_{c1}$ and $A_{c3}$ transformation points. This means a small resistance to temper softening, which reduces long term creep strength. In addition, when these elements are present, the structure of oxides primarily composed of $Cr_2O_3$ is changed. This also brings about another disadvantage that resistance to steam oxidation decreases. In addition, the high chromium ferritic steels disclosed in the latter publication are poor in strength at welded joints, particularly long term creep strength because of softening at heat affected zones (HAZ).

Japanese Patent Application Laid-open (kokai) No. 2-294452 discloses high chromium ferritic steel in which the amounts of Mn, Ni, Cu, etc. are limited at a low level to prevent δ-ferrite formed in heat affected zones in an attempt to enhance toughness in welded joints. Japanese Patent Application Laid-open (kokai) No. 6-65689 discloses heat-resistant steel in which softening of heat affected zones is prevented by dispersion hardening of an oxide such as Ta205. However, the steels disclosed in these publications do not have sufficient long term creep strength at elevated temperatures and toughness that would satisfactorily meet the aforementioned severe requirements.

Thus, development is still desired of high chromium ferritic heat-resistant steels which satisfy the requirements of long term creep strength, toughness, and resistance to steam oxidation under ultra-super critical conditions of high temperature and high pressure, and which, when welded, also satisfy severe requirements called for welded joints including long term creep strength at elevated temperatures and toughness.

The present invention was made in view of the foregoing circumstances, and an object of the invention is to provide a high chromium ferritic heat-resistant steel which has excellent long-term creep strength and high resistance to steam oxidation at high temperatures over 600° C. and prominent toughness at room temperatures. Moreover, the present invention provides a high chromium ferritic heat-resistant steel which, when welded, exhibits excellent long term creep strength at elevated temperatures and toughness at room temperatures in welded joints.

SUMMARY OF THE INVENTION

The present invention provides a heat-resistant steel which can be advantageously used, for example, as a materiel of boilers operated under ultra-super critical conditions of high temperature and high pressure. More specifically, the present invention provides a high chromium ferritic heat-resistant steel, wherein the base metal and a welded joint thereof have excellent long term creep strength and resistance to steam oxidation at elevated temperatures over 600° C. and have remarkable toughness at room temperatures.

The essential chemical composition of the steel of the present invention in weight percent is as follows.

| | | | |
|---|---|---|---|
| C: | 0.02 to 0.15%, | Si: | 0 to 1.0%, |
| Mn: | 0.05 to 1.5%, | Ni: | 0 to 1.5%, |
| Cr: | 8.0 to 13.0%, | W: | 1.5 to 4.0%, |
| Mo: | 0 to 1.0%, | Co: | 2.5 to 8.0%, |
| V: | 0.10 to 0.50%, | Ta: | 0.01 to 0.50%, |
| Nb: | 0 to 0.15%, | Nd: | 0.001 to 0.24%, |
| Ca: | 0 to 0.010%, | Mg: | 0 to 0.010%, |
| N: | 0.020 to 0.12%, | B: | 0 to 0.030%, |
| sol. Al: | 0.001 to 0.050%, and | | |
| balance: | Fe and incidental impurities. | | |

The steel of the present invention contains, in addition to the above described essential chemical composition, one or more elements of the following group 1, one or more elements of the following group 2, or one or more elements from each of the groups 1 and 2.

| | | | |
|---|---|---|---|
| Group 1: | | | |
| Sc: | 0.001 to 0.08%, | Y: | 0.001 to 0.15%, |
| La: | 0.001 to 0.23%, | Ce: | 0.001 to 0.23%, |
| Group 2: | | | |
| Hf: | 0.005 to 0.60%, | Ti: | 0.005 to 0.15%, |
| Zr: | 0.005 to 0.30%. | | |

When more improved properties are required for welded joints in terms of creep strength at elevated temperatures and toughness, the amounts of W, Mo, Ta, Nb, and B are preferably in the following ranges:

| | | | |
|---|---|---|---|
| W: | 2.5 to 4.5%, | Mo: | 0 to 0.2%, |
| Ta: | 0.01 to 0.20%, | Nb: | 0.01 to 0.15%, |
| B: | 0 to 0.020%. | | |

DESCRIPTION OF THE INVENTION AND PREFERRED EMBODIMENTS

The inventors of the present invention carried out research in an attempt to develop high chromium ferritic heat-resistant steels, wherein the base metal and a welded joint of the steel have excellent long term creep strength and resistance to steam oxidation at elevated temperatures over 600° C. and have remarkable toughness at room temperature. The inventors carefully studied of the relation between steel characteristics such as long term creep strength at elevated temperatures, resistance to steam oxidation, and toughness of high chromium ferritic steels and their welded joints and their chemical composition or metallographic structures. As a result, the inventors found the following.

Long term creep strength and toughness:

1) When high chromium ferritic steels take normalizing and tempering treatments, they become to have a martensite structure in which carbo-nitrides have precipitated. The steel with a martensite structure in this condition has excellent creep strength. However, when these steels are used at temperatures over 600° C., their creep strength is not maintained since the martensite structure is recovered and softened as time passes.

2) In order to improve the long term creep strength of high chromium ferritic steels at elevated temperatures over 600° C., it is particularly effective that fine μ phase of the $Fe_7W_6$-type is precipitated and dispersed uniformly in the matrix of steels over a prolonged period of use. The reason for this is that the μ phase is capable of maintaining creep strength after the martensite structure is recovered and softened. In addition, since μ phases can stably exist at high temperature, the benefits of μ phase can be enjoyed even over 600 ° C.

3) In order to have fine μ phase precipitated in a dispersed state, a single but abundant use of W, or in the case where W and Mo are used in combination, a reduction in ratio Mo/W is effective. This is because if Mo is contained in large amounts, μ phases are locally precipitated in prior austenite grain boundaries and in the interface of martensite lath, whereas if W is contained in large amounts, μ phases are precipitated not only in grain boundaries but also in the grains because a diffusion of W is slow.

4) Under conditions where fine μ phases are precipitated in a dispersed state, decrease in toughness attributed to u phases does not occur.

Resistance to steam oxidation:

5) Scale layers generated on the surface of high chromium ferritic steels are composed of dense corundum type oxides, which are primarily chromium oxides. These oxides inhibit steam oxidation. If, however, Mo is present in scales, the scale layers are converted to have a spinel type brittle structure, which reduces resistance to steam oxidation significantly, because the scale layers are cracked by temperature changes during service and come off easily. W does not adversely affect resistance to steam oxidation. Therefore, addition of W and reduction of Mo can improve resistance to steam oxidation.

6) When Nd (Neodium), which has a very strong tendency of forming oxides, is added to steel, the adverse effect of Mo with respect to resistance to steam oxidation can be mitigated.

7) To obtain a maximum effect of Nd, addition of one or more elements of Sc, Y, La, or Ce is effective.

Properties of welded joints:

8) In welded joints of high chromium ferritic steels having a single martensite phase, long term creep-rupture occurs in a boundary between a heat affected zone (HAZ) and a base metal in a shearing mode. The shear fracture in this boundary is caused by creep strains concentrated to the softening layer in a HAZ. To prevent this, elimination of the local softening layer or dispersion of the softening layer is effective.

9) The softening layer in a HAZ is formed as a result that a soft martensite structure is generated when a steel is heat-treated after welding. Since softening in the boundary between a HAZ and the base metal is severe, the above-mentioned rupture occurs, Thus, rupture is not caused by the generation of a δ-ferrite phase formed in the cooling process after welding as was conventionally considered.

10 ) The long term creep strength of the base metal and welded joint at elevated temperatures can be improved by adding Nd and Ta into steel. If long term creep strength of welded joints at elevated temperatures is desired to be further improved. Hf and Nb are also added together with Nd and Ta.

The present invention was accomplished based on the above findings. The technical concepts of the present invention are summarized as follows.

a) Long term creep strength and toughness are improved by precipitating fine u phases primarily comprising $Fe_7W_6$ phases in a dispersed state.

b) The amount of Mo which has adverse effect for resistance to steam oxidation is restricted to a degree that is required for securing the strength of the steel. The reduction of Mo is compensated by W.

c) When Mo is contained, Nd is added or a combination of Nd and at least one elements of Sc, Y, La, and Ce is added in order to maintain resistance to steam oxidation.

d) Long term creep strength of a base metal and welded joints at elevated temperatures are improved by adding both Nd and Ta. If long term creep strength of welded joints at elevated temperatures are desired to be further improved. Hf and Nb are added together with Nd and Ta.

Next, how the alloy elements of the high chromium ferritic heat-resistant steel of the present invention affect characteristics of the steel will be described along with the amount of each alloy element, and the reason that justifies the limitation of amount will be described.

C: C forms a carbide MC (wherein M is an alloy element) such as $M_7C_3$, $M_{23}C_6$ (in some cases, C forms a carbonitride M(C,N)). The carbide affects characteristics of the steel of the invention significantly. Generally, high chromium ferritic steels are used in condition of tempered martensite structure obtained by normalizing and tempering treatments. When they are used under conditions of a high temperature for a long period, precipitation of carbides such as VC and (Nb, Ta) C proceeds. These carbides function to maintain long term creep strength. In order to obtain this effect of carbides, presence of C in an amount not less than 0.02% by weight (hereinafter simply referred to as %) is required. However, if the carbon content is in excess of 0.15% and when the steel is used at a high temperature, coalescence and coarsening of carbides occur from the initial stage of use and long term creep strength deteriorates. Therefore, the proper carbon content is from 0.02 to 0.15%, and preferably from 0.06 to 0.12%.

Si: Si is used as a deoxidizer for molten steel. Moreover, Si is an element effective for improving resistance to steam oxidation at high temperatures. However, when it is excessively contained in steel, it reduces toughness of the steel. Therefore, an amount of not more than 1% is advisable. If molten steel is deoxidized with a sufficient amount of Al, the presence of Si is not necessarily required.

Mn: Mn, which fixes S as MnS, is generally added to improve workability of steel in hot working. In the steel of the present invention, Mn has an additional effect of improving short term creep strength under conditions of a high stress. This additional effect is obtainable when not less than 0.05% of Mn is contained. However, the amount of Mn in excess of 1.5% reduces toughness of the steel. Therefore, the Mn content is determined in the range from 0.05 to 1.5%. Preferably, the Mn content is 0. 10 to 1.0%.

Ni: Ni is an arbitrary element. Ni functions to improve toughness of steel. Therefore. Ni is used for improving long term creep strength and toughness and enhancing creep strength and toughness by stabilizing the structure. Since these effects are obtained from the Ni content of not less than 0.10%. if Ni is added, not less than 0.10% of Ni content is preferred. The Ni content in excess of 1.50% decreases the Ac1 transformation point of the steel, resulting in a reduced strength of the steel. Therefore, in the case where Ni is added, the amount of 0.10 to 1.50% is preferred.

Cr: Cr is an indispensable element in the steel of the present invention for securing anti-corrosion property and resistance to oxidation, especially resistance to steam oxidation at high temperatures. When Cr is contained in the steel, a dense scale primarily composed of Cr oxides is formed in the surface of the steel. This scale acts to improve anti-corrosion property and resistance to oxidation, especially resistance to steam oxidation, of the steel of the present invention. Cr also improves creep strength by forming a carbide. To obtain these effects. Cr must be contained in an amount not less than 8.0%. If its amount is in excess of 13.0%, the steel is inclined to form δ-ferrite, which results in a reduction in toughness. Therefore, the Cr content is determined from 8.0 to 13.0%. Preferably, the Cr content is from 9.0 to 12.0%.

W: W is one important elements in the steel of the of present invention enhancing creep strength. W forms for inter-metallic compounds primarily composed of u phases of the $Fe_7W_6$ type when the steel is used at a high temperature. These inter-metallic compounds precipitate in grains of steel in a finely dispersed state. As a result, long term creep strength is enhanced. In addition, since W is partly soluble in Cr carbides and suppresses coalescence and coarsening of carbides. W is effective for maintaining the strength of the steel of the present invention at high temperatures. In order to obtain this effect, W content of not less than 1.5% is needed. When the W content is in excess of 4.0%, the steel is inclined to form 5-ferrite, which results in a reduction in toughness. Therefore, the W content is determined to be from 1.5 to 4.0%. If Mo is not present in the steel. W content is preferably from 2.5 to 4.0% for securing the strength of the steel.

Mo: Mo primarily functions to effect a solid-solution hardening by forming a solid solution with the matrix and effect a precipitation hardening by forming precipitates. Especially, carbides of the $M_{23}C_6$ type or $M_7C_3$ type which contain Mo are very effective components for securing long term creep strength since they are stable at high temperatures. However, Mo is a harmful element in terms of resistance to steam oxidation as mentioned before. This detrimental effect can be mitigated when Nd is also added, or Nd and at least one element of Sc, Y, La, or Ce are added. Even in this case, however, a large amount of use in excess of 1.0% invites reduction in toughness. Therefore, if Mo is added, it is preferably contained in an amount not more than 1.0%. To obtain the above-mentioned effect of Mo, presence of not less than 0.20% is preferred. Particularly, if long term creep strength and toughness is strongly required in welded joints, it is preferred that Mo be present in a small amount, preferably not more than 0.2%.

Co: Co accelerates precipitation of μ phases of the $Fe_7W_6$ type in the state of present invention, contributing to the improvement in creep strength. In addition, Co is an austenite forming element and contributes to the stabilization of a martensite structure. To obtain these effects, a Co content of not less than 2.5% is required. However, when the Co content is in excess of 8.0%, the Acl point of the steel significantly decreases to weaken the strength. Therefore, the content of Co is determined to be from 2.5 to 8.0%.

V: V contributes to the enhancement of creep strength by forming fine carbo-nitrides. Its effect becomes apparent when it is contained in an amount not less than 0.10%. If it is contained in excess of 0.50%, its effect saturates. Therefore, the V content is determined to be from 0.10 to 0.50%.

Ta: Ta is an essential element in the high chromium ferritic heat-resistant steel in the present invention. Ta, forming nitrides and carbo-nitrides together with Nb, contributes to the improvement in strength and toughness. Moreover, since it defers precipitation of u phases of the $Fe_7W_6$ type, it enhances long term creep strength of the steel. To obtain this effect, it is necessary that Ta be contained in an amount not less than 0.01%. The Ta content in excess of 0.50% coarsens sizes of nitrides, thereby reducing toughness of the steel. Thus, the Ta content is determined to be from 0.01 to 0.50%. Moreover, carbo-nitrides of Ta or carbo-nitrides of Ta and Nb which are precipitated in the steel in a finely dispersed state continue to exist in welded joints after welded. Thus. Ta functions to suppress softening of welded joints to increase long term creep strength. As far as welded joints are concerned. Ta content in excess of 0.20% reduces toughness of the steel. Therefore. Ta content of not more than 0.20% is preferred. When welded joints are required to have long-term creep strength at elevated temperatures and toughness. Ta content is preferably from 0.01 to 0.20%.

Nb: Nb improves strength and toughness of the steel by forming nitrides and carbo-nitrides. To obtain this effect, not less than 0.01% of Nb must be present. However, excessive amounts of Nb reduce toughness. Therefore, Nb is preferably contained in an amount from 0.01 to 0. 15%. Nd: Nd is an essential element in the high chromium ferritic heat-resistant steel of the present invention. Nd has a strong tendency of forming oxides. The fine oxides formed are present in the steel in a dispersed state. When high chromium ferritic steels are exposed to steam of high temperatures and high pressure, scales mainly composed of Cr oxides are formed. In this case, fine Nd oxides dispersed in the surface of steel function to inhibit growth of Cr oxides. As a result, scale growth is suppressed, and at the same time, scales are densified. Accordingly, proper amounts of Nd contained in the steel dramatically improves resistance to steam oxidation of the steel. In addition. Nd fixes oxygen in steel by forming a Nd oxide, which in turn prevents Ta, Nb, etc. from being bound to oxygen to form oxides. In other words, Nd helps Ta and Nb form nitrides and carbo-nitrides. Thus, Nd is said to indirectly improve strength and toughness of the steel. Such an effect of Nd is obtained when it is contained in an amount from 0.001 to 0.24%. If Nd is present in excess of 0.24%. harmful effects are apparent in reducing toughness of the steel.

Hf, Ti, Zr: Hf, Ti, and Zr have a strong tendency of forming an oxide. At the same time, they are strong carbo-nitride-forming elements when oxygen is not available by being fixed by other elements. When these elements are contained in small amounts, the resulting steel has a very fine structure. As a result, strength and toughness of the steel are enhanced. To obtain these effects, at least one of Hr, Ti, and Zr is contained in the steel as desired. The effects are apparent when Hr, Ti, or Zr is contained in an amount not less than 0.005%. Therefore, any one of them is preferably contained, if it is ever contained, not less than 0.005%. However, if they are contained in great amounts, i.e., in excess of 0.15% in the case of Ti, in excess of 0.30% in the case of Zr, and in excess of 0.60% in the case of Hr, they form coarse nitrides to catastrophically decrease toughness of the steel. Accordingly, the upper limits of these elements are preferably 0.15%, 0.30%, and 0.60%, respectively.

When long term creep strength at elevated temperatures and toughness of welded joints are desired to be improved by fixing oxygen by these elements to promote the formation of carbo-nitrides of Ta or carbo-nitride complexes of Ta and Nb, these elements are preferably contained in smaller amounts. Excessive amounts of Hr, etc. decrease toughness in welded joints. Thus, in order for characteristics of welded joints to be improved, any one of these elements must be contained in the range from 0.001 to 0.20%.

N: N is an important element which contributes to the enhancement of creep strength and toughness by forming nitrides and carbo-nitrides. To obtain such an effect, it is necessary that N be contained in the steel in an amount not less than 0.01%. However, if N is contained in excess of 0.12%. nitrides are coarsened to significantly reduce toughness. Therefore, the N content is determined to be from 0.01 to 0.12%. Preferably. N is contained in an amount from 0.04 to 0.08%.

B: When a small amount of B is contained in the steel, very fine $M_{23}C_6$-type carbides are precipitated in the state of dispersion. As a result, long term creep strength at elevated temperatures is improved. If B is contained, for example, in thick-wall materials which cool slowly after they are heat-treated, B functions to enhance strength at elevated temperatures by improving their hardenability. Therefore, B may be added for this purpose of enhancing strength at high temperatures. The content of B is preferably not less than 0.0005% to maximize its B effects. If B is contained in excess of 0.030%, coarse precipitates are formed to reduce toughness. Therefore, the upper limit of B is determined to be 0.030%. If long term creep strength at elevated temperatures and toughness are desired to be secured, the upper limit of B is preferably 0.020% since high content of B causes coalescence and coarsening of carbo-nitrides to reduce strength of the steel.

Sol. Al: Al is added primarily as a deoxidizer for molten steel. In the steel, two types of Al are present; one is Al oxides and the other is Al other than oxides. In chemical analysis, the latter Al is generally distinguished from the former as being an HCl-soluble Al (sol. Al). In order to obtain the deoxidizing effect, it is necessary that sol. Al be contained in an amount not less than 0.001%. However, if sol. Al is present in excess of 0.050%, creep strength is decreased. Therefore, the content of sol. Al is determined to be from 0.001 to 0.050%. Preferably, sol. Al is contained in an amount from 0.01 to 0.03%.

Sc, Y, La, Ce: These elements have a strong tendency of producing oxides as does the aforementioned Nd. When one or more elements are selected from this group of elements and added to the steel, the resulting steel contains very fine oxides in a dispersed state. Such a steel has an extremely high resistance to steam oxidation as described under the title of Nd. Therefore, if resistance to steam oxidation is strongly required, combined use with one or more of these elements is preferred. To obtain their effects, the following amounts are proper in cases where a single element of them are contained. Sc: 0.001 to 0.08%. Y: 0.001 to 0.15%, La: 0.001 to 0.23%, and Ce: 0.001 to 0.23%.

In order for the effects of these elements to exhibit more significantly, they are contained in such amounts that satisfy the following expression (1):

$$O\ (oxygen) \leqq SEQ \leqq 0.060 \quad (1)$$

wherein $$SEQ = 48.0 \times (Nd/288.40 + Sc/89.91 + Y/177.92 + La/277.81 + Ce/280.24) \quad (2)$$

wherein each element symbol represents the content (% by weight) of the element.

This expression was first found by the present inventors in the course of pursuing their research and experiments. If these elements do not satisfy the conditions defined by the above expression, their effects in improving the resistance to steam oxidation are small.

If the SEQ value is less than the oxygen content, scales tend to become thick when steam oxidation occurs. On the other hand, if the SEQ value is in excess of 0.060. toughness tends to drop sharply.

Ca, Mg: Ca and Mg function to improve the workability of the steel in hot working. Therefore, they are preferably contained in the steel for this purpose. This effect is obtained when not less than 0.0005% of Ca or Mg is contained. Thus, they are preferably contained in an amount not less than 0.005% in both cases where single species of them is used or they are used in combination. Their content in excess of 0.010% invites coarsening of inclusions to impede workability and reduce toughness. Therefore, the upper limit for each of these elements is set to be 0.010%.

P, S: These elements are contained in the steel as incidental impurities. They adversely affect workability of the steel in hot working, toughness of welded joints, etc. Their content is preferably as low as possible. More specifically, the amounts of P and S are not more than 0.030% and not more than 0.015%, respectively.

O (oxygen): O is contained in the steel as an unavoidable impurity element. When O is locally present in the steel in the form of coarse oxides, toughness of the steel is adversely affected. Especially, for securing toughness of the steel, the amount of O must be as small as possible. In view that toughness is only slightly affected when the amount of O is not more than 0.010%, the upper limit of the O content is preferably 0.010%.

Relation between Nd or Nb and O: As described herein before, Nd and Nb have a strong tendency of being bound to O and forming oxides. In order to have nitrides and carbo-nitrides of Nd and Nb precipitated, the presence of Nd and Nb which are not bound to O is required. Therefore, Nd, Nb, and O are preferably contained in amounts that satisfy the following expressions (3) and (4):

$$0 \leqq P_{Nd} \leqq 0.103 \quad (3)$$

$$0.005 \leqq P_{Nb} \leqq 0.03 \quad (4)$$

wherein $$P_{Nd} = Nd - 6.01 \times O\ (oxygen) \quad (5)$$

$$P_{Nb}: 0.151 \times Nb + 0.0971 \times P_{Nd} \quad (6)$$

wherein each element symbol represents the content (% by weight) of the element.

The steel of the present invention can be manufactured using facilities and processes which are usually employed in the industry. The steel having the chemical composition defined by the present invention, is obtained by smelting in a furnace such as an electric furnace and a converter, which is followed regulation of components by adding deoxidizers and alloy elements. The conditions defined by expressions (1), (3), and (4) are satisfied by adding alloy elements taking account of the O content in molten steel after deoxidation and the yield of each alloy element, which are empirically obtained. If a very strict element regulation is desired, molten steel may be vacuum-treated before alloy elements are added thereto.

The molten steel which has undergone regulation of chemical composition are cast into slabs, billets and ingots by continuous casting process or ingot making process. Steel tubes and sheets are made of the thus-obtained slabs and ingots, When seamless tubes are manufactured, billets are extruded to form tubes. When steel sheets are manufactured, slabs are subjected to hot rolling to obtain hot-rolled sheets. Cold-rolled sheets are manufactured by cold rolling hot-rolled sheets.

EXAMPLES

The properties of the steel of the present invention are demonstrated by the following two examples. The test methods and results obtained therefrom are next described in detail.

Example 1:

The chemical composition of each sample used in the test is shown in Tables 1 and 2.

TABLE 1

| Sample | CHEMICAL COMPOSITION (% by weight) | | | | | | | | | | | | | | | | | | |
|---|---|---|---|---|---|---|---|---|---|---|---|---|---|---|---|---|---|---|---|
| No. | C | Si | Mn | P | S | Cr | W | Mo | Co | V | Ta | Nd | N | sol. Al | Other elements | | | 0 | SEQ *2 |
| 1 | 0.11 | 0.30 | 0.53 | 0.018 | 0.0013 | 9.27 | 2.66 | 0.49 | 5.01 | 0.26 | 0.12 | 0.023 | 0.065 | 0.009 | | | | 0.0019 | 0.0038 |
| 2 | 0.10 | 0.32 | 0.53 | 0.023 | 0.0006 | 9.44 | 2.63 | 0.87 | 5.23 | 0.15 | 0.13 | 0.086 | 0.058 | 0.012 | Ni: 0.15, | B: | 0.0033 | 0.0024 | 0.0143 |
| 3 | 0.09 | 0.14 | 0.45 | 0.018 | 0.0008 | 9.26 | 2.59 | 0.46 | 4.55 | 0.26 | 0.16 | 0.037 | 0.054 | 0.009 | Y: 0.031 | | | 0.0027 | 0.0145 |
| 4 | 0.11 | 0.31 | 0.54 | 0.014 | 0.0007 | 9.58 | 2.92 | 0.54 | 5.06 | 0.35 | 0.14 | 0.091 | 0.057 | 0.012 | Ni: 1.13, | La: | 0.057 | 0.0031 | 0.0250 |
| 5 | 0.10 | 0.16 | 0.51 | 0.025 | 0.0007 | 9.83 | 2.98 | 0.28 | 3.68 | 0.25 | 0.14 | 0.035 | 0.049 | 0.014 | Ti: 0.01, | Hf: | 0.02 | 0.0052 | 0.0058 |
| 6 | 0.08 | 0.08 | 0.24 | 0.015 | 0.0004 | 10.33 | 2.99 | 0.15 | 4.02 | 0.21 | 0.07 | 0.055 | 0.052 | 0.004 | Sc: 0.012, Nb: 0.07 | Mg: | 0.0025 | 0.0026 | 0.0149 |
| 7 | 0.10 | 0.15 | 0.20 | 0.003 | 0.0005 | 10.74 | 3.02 | 0.01 | 4.33 | 0.28 | 0.10 | 0.048 | 0.058 | 0.003 | Zr: 0.024, Ce: 0.011 | La: | 0.032 | 0.0055 | 0.0154 |
| 8 | 0.11 | 0.32 | 0.15 | 0.013 | 0.0009 | 11.20 | 2.88 | 0.10 | 4.89 | 0.24 | 0.08 | 0.038 | 0.061 | 0.011 | Ti: 0.013, | Ca: | 0.0025 | 0.0010 | 0.0063 |
| 9 | 0.09 | 0.25 | 0.45 | 0.002 | 0.0007 | 9.86 | 2.89 | 0.08 | 4.92 | 0.25 | 0.11 | 0.082 | 0.055 | 0.009 | Zr: 0.025, | La: | 0.022 | 0.0021 | 0.0174 |
| 10 | 0.10 | 0.20 | 0.20 | 0.014 | 0.0005 | 10.51 | 2.85 | 0.05 | 4.06 | 0.21 | 0.09 | 0.055 | 0.071 | 0.007 | Y: 0.033, | Ca: | 0.0036 | 0.0043 | 0.0181 |
| 11 | 0.13 | 0.22 | 0.21 | 0.016 | 0.0004 | 9.75 | 3.02 | 0.23 | 4.53 | 0.31 | 0.13 | 0.048 | 0.063 | 0.008 | Hf: 0.023, Mg: 0.0017 | Sc: | 0.020 | 0.0022 | 0.0187 |
| 12 | 0.11 | 0.25 | 0.24 | 0.025 | 0.0008 | 10.22 | 3.15 | 0.05 | 4.33 | 0.24 | 0.09 | 0.044 | 0.059 | 0.007 | Nb: 0.04 | | | 0.0012 | *3 |
| 13 | 0.10 | 0.15 | 0.28 | 0.024 | 0.0009 | 10.54 | 3.05 | 0.10 | 4.19 | 0.28 | 0.05 | 0.032 | 0.058 | 0.004 | Nb: 0.07, | Y: | 0.031 | 0.0017 | *4 |

*2: SEQ = 48.0(Nd/288.4 + Sc/89.91 + Y/177.92 + La/277.81 + Ge/280.24)

*3: SEQ = 0.0073, $P_{Nd}$ = Nd − 6.01 × 0(oxygen) = 0.0369, $P_{Nb}$ = 0.151 × Nb + 0.0971 × $P_{Nd}$ = 0.0096

*4: SEQ = 0.0137, $P_{Nd}$ = 0.0368, $P_{Nb}$ = 0.0051

TABLE 1

| Sample | CHEMICAL COMPOSITION (% by weight) | | | | | | | | | | | | | | | | | | | | | |
|---|---|---|---|---|---|---|---|---|---|---|---|---|---|---|---|---|---|---|---|---|---|---|
| No. | C | Si | Mn | P | S | Cr | W | Mo | Co | V | Ta | Nd | N | sol. Al | Other elements | | | | | | 0 | SEQ *2 |
| 14 | 0.01* | 0.31 | 0.51 | 0.013 | 0.0012 | 9.03 | 2.55 | 0.41 | 3.03 | 0.25 | 0.05 | — | 0.063 | 0.014 | Sc: | 0.005 | | | | | 0.0025 | 0.0027 |
| 15 | 0.16* | 0.33 | 0.45 | 0.021 | 0.0010 | 9.21 | 2.61 | 0.45 | 3.12 | 0.26 | 0.11 | — | 0.065 | 0.013 | Y: | 0.015 | | | | | 0.0030 | 0.0040 |
| 16 | 0.13 | 1.17* | 0.52 | 0.009 | 0.0008 | 9.13 | 2.54 | 0.56 | 3.45 | 0.24 | 0.12 | — | 0.059 | 0.015 | Ti: | 0.01, | Y: | 0.013 | | | 0.0021 | 0.0035 |
| 17 | 0.11 | 0.34 | 2.23* | 0.015 | 0.0009 | 9.04 | 2.83 | 0.32 | 3.06 | 0.25 | 0.13 | — | 0.064 | 0.013 | Ni: | 0.15, | Y: | 0.025 | | | 0.0035 | 0.0067 |
| 18 | 0.09 | 0.35 | 0.20 | 0.025 | 0.0008 | 7.28* | 2.66 | 0.53 | 3.49 | 0.25 | 0.12 | — | 0.065 | 0.012 | Ni: | .26, | Y: | .058, | La: | .049 | 0.0032 | 0.0241 |
| 19 | 0.09 | 0.31 | 0.31 | 0.013 | 0.0009 | 13.25* | 2.81 | 0.39 | 3.46 | 0.21 | 0.15 | — | 0.160 | 0.015 | Ni: | 0.45, | Ti: | 0.02, | | | 0.0043 | 0.0126 |
| | | | | | | | | | | | | | | | La: | 0.073 | | | | | | |
| 20 | 0.09 | 0.36 | 0.54 | 0.015 | 0.0008 | 9.25 | 2.18 | 1.35* | 3.24 | 0.22 | 0.20 | — | 0.060 | 0.009 | La: | 0.055, | Ca: | 0.0023 | | | 0.0050 | 0.0095 |
| 21 | 0.11 | 0.31 | 0.82 | 0.014 | 0.0009 | 9.34 | 4.37* | 0.44 | 3.74 | 0.23 | 0.13 | — | 0.065 | 0.012 | La: | 0.013, | Ce: | 0.014 | | | 0.0041 | 0.0046 |
| 22 | 0.10 | 0.21 | 0.16 | 0.008 | 0.0008 | 9.16 | 2.82 | 0.38 | 1.53* | 0.25 | 0.12 | — | 0.064 | 0.014 | Ti: | 0.01, | Zr: | 0.02, | Hf: | 0.01, | 0.0038 | 0.0276 |
| | | | | | | | | | | | | | | | La: | 0.135, | Ce: | 0.025 | | | | |
| 23 | 0.09 | 0.15 | 0.50 | 0.009 | 0.0007 | 9.41 | 2.46 | 0.51 | 9.12* | 0.23 | 0.14 | — | 0.061 | 0.008 | Ni: | 0.18, | Ce: | 0.061 | | | 0.0053 | 0.0104 |
| 24 | 0.10 | 0.10 | 0.54 | 0.002 | 0.0012 | 9.37 | 3.25 | 0.60 | 5.06 | 0.02* | 0.12 | — | 0.058 | 0.018 | Ni: | 0.26, | Ti: | 0.03, | | | 0.0065 | 0.0146 |
| | | | | | | | | | | | | | | | Ce: | 0.085 | | | | | | |
| 25 | 0.09 | 0.35 | 0.53 | 0.025 | 0.0005 | 9.28 | 3.01 | 0.57 | 5.32 | 0.56* | 0.10 | 0.035 | 0.057 | 0.012 | Y: | 0.015, | Ce: | 0.077 | | | 0.0029 | 0.0231 |
| 26 | 0.10 | 0.30 | 0.51 | 0.021 | 0.0012 | 9.25 | 2.68 | 0.49 | 5.06 | 0.30 | 0.68* | 0.029 | 0.053 | 0.011 | Ti: | 0.04, | Zr: | 0.02, | | | 0.0018 | 0.0048 |
| 27 | 0.09 | 0.29 | 0.46 | 0.020 | 0.0013 | 9.14 | 2.67 | 0.58 | 4.91 | 0.29 | 0.21 | — | 0.058 | 0.055* | Y: | 0.024 | | | | | 0.0033 | 0.0065 |
| 28 | 0.10 | 0.31 | 0.50 | 0.021 | 0.0009 | 9.20 | 2.68 | 0.43 | 3.51 | 0.25 | 0.12 | — | 0.056 | 0.015 | La: | 0.024 | | | | | 0.0098 | 0.0041* |
| 29 | 0.11 | 0.35 | 0.54 | 0.018 | 0.0015 | 9.21 | 2.57 | 0.44 | 4.02 | 0.26 | 0.14 | — | 0.057 | 0.014 | Ce: | 0.036 | | | | | 0.0098 | 0.0062* |
| 30 | 0.09 | 0.30 | 0.81 | 0.027 | 0.0008 | 10.91 | 3.08 | 0.81 | 5.25 | 0.30 | 0.19 | 0.045 | 0.063 | 0.016 | Nb: | 0.03 | | | | | 0.0091 | *5 |
| 31 | 0.13 | 0.59 | 0.37 | 0.021 | 0.005 | 8.78 | — | 1.01 | — | — | — | — | 0.026 | 0.003 | Ni: | 0.13 | | | | | — | — |
| 32 | 0.08 | 0.27 | 0.53 | 0.015 | 0.004 | 9.31 | — | 2.13 | — | — | — | — | 0.014 | 0.011 | Ni: | 0.12 | | | | | — | — |
| 33 | 0.11 | 0.42 | 0.39 | 0.014 | 0.003 | 8.42 | — | 0.95 | — | 0.21 | — | — | 0.051 | 0.012 | Ni: | 0.06, | Nb: | 0.07 | | | — | — |
| 34 | 0.22 | 0.52 | 0.43 | 0.011 | 0.006 | 12.12 | 0.57 | 1.03 | — | 0.35 | — | — | 0.041 | 0.021 | Ni: | 0.15 | | | | | — | — |

*Outside the range of the present invention

*2: SEQ = 48.0(Nd/288.4 + Sc/89.91 + Y/177.92 + La/277.81 + Ce/280.24)

*5: SEQ = 0.0025, $P_{Nd}$ = Nd − 6.01 × 0 = −0.0097, $P_{Nb}$ = 0.151 × Nb + 0.0971 × $P_{Nd}$ = 0.0036

In Table 1, the chemical compositions of the samples of the present invention are shown. In Table 2, the chemical compositions of the comparative samples are shown. Each sample was obtained as follows. First, starting materials were melted in a vacuum high frequency induction furnace having a capacity of 50 kg. The molten steel was regulated to have a predetermined chemical composition, and then cast into an ingot having a diameter of 144 mm. The obtained ingot was subjected to hot forging at 1,300 to 1,000° C. to obtain a test piece having a size of 200 mm in width, 400 mm in length, and 25 mm in thickness. The samples were respectively heat-treated. Nos. 18 and 19 samples were normalized at 950° C. for 1 hour and subsequently cooled in air, and further tempered at 750° C. for 1 hour and subsequently cooled in air. Other samples had taken a normalizing treatment in which they were retained at 1050° C. for 1 hour and cooled in air, and a tempering treatment in which they were retained at 780° C. for 1 hour and cooled in air. From the thus prepared samples, test pieces for evaluating the steel in terms of long term creep strength at elevated temperatures, toughness, and resistance to steam oxidation were prepared.

In Table 2, Nos. 31 to 34 are conventional high chromium ferritic steels. No. 31, No. 32, No. 33, and No. 34 are samples having the chemical compositions specified in JIS-STBA26. STBA27 (Standards of Thermal and Nuclear Power Engineering Society). ASTM-A213-T91. and DIN-X20CrMoWV121, respectively.

The creep strength at elevated temperatures, toughness, and resistance to steam oxidation were evaluated as follows.

Creep strength at elevated temperatures:

Creep strength at elevated temperatures was evaluated by a creep-rupture test under the following conditions:

Test piece: Diameter—6.0 mm, gauge length=30 mm,

Retention Temperature: 650° C.,

Stress: 100 MPa,

Item measured: rupture time.

Toughness:

Toughness was evaluated by a Charpy impact test under the following conditions:

Test piece: 10 mm in width, 10 mm in thickness, 55 mm in length; 2 mm V notch

Test temperature: 0° C.,

Item measured: Impact value.

Resistance to steam oxidation:

Resistance to steam oxidation was evaluated by a steam oxidation test under the following conditions.

Test atmosphere: Steam of 700° C.,

Retention time: 1000 hours,

Item measured: Thickness of scale layers.

Tables 3 and 4 show the results of these tests.

TABLE 3

| Sample No. | Creep-rupture time (hr) | Impact value $vE_0$ ($J/cm^2$) | Thickness of scale layers (μm) |
|---|---|---|---|
| 1 | 14983 | 202 | 51 |
| 2 | 15643 | 179 | 58 |
| 3 | 14891 | 145 | 63 |
| 4 | 17389 | 150 | 69 |
| 5 | 15722 | 171 | 65 |
| 6 | 13892 | 162 | 72 |
| 7 | 14041 | 159 | 69 |
| 8 | 13704 | 183 | 74 |
| 9 | 15006 | 210 | 83 |
| 10 | 14339 | 187 | 65 |
| 11 | 14721 | 192 | 70 |

TABLE 3-continued

| Sample No. | Creep-rupture time (hr) | Impact value $vE_0$ ($J/cm^2$) | Thickness of scale layers (μm) |
|---|---|---|---|
| 12 | 15116 | 177 | 69 |
| 13 | 14282 | 160 | 52 |

TABLE 4

| Sample No. | Creep-rupture time (hr) | Impact value $vE_0$ ($J/cm^2$) | Thickness of scale layers (μm) |
|---|---|---|---|
| 14 | 673 | 80 | 66 |
| 15 | 5327 | 93 | 103 |
| 16 | 6231 | 36 | 55 |
| 17 | 7010 | 45 | 89 |
| 18 | 5834 | 236 | 115 |
| 19 | 8015 | 48 | 65 |
| 20 | 4356 | 176 | 114 |
| 21 | 8147 | 43 | 83 |
| 22 | 7633 | 154 | 66 |
| 23 | 6891 | 152 | 104 |
| 24 | 4321 | 243 | 52 |
| 25 | 7128 | 98 | 98 |
| 26 | 9017 | 27 | 97 |
| 27 | 6849 | 65 | 81 |
| 28 | 10248 | 102 | 161 |
| 29 | 10054 | 95 | 131 |
| 30 | 9325 | 82 | 122 |
| 31 | 10 | 101 | 154 |
| 32 | 18 | 174 | 140 |
| 33 | 812 | 305 | 137 |
| 34 | 98 | 105 | 72 |

The Table 3 data are obtained from sample steels of the present invention, and Table 4 data are obtained from the comparative steels and conventional steels.

As shown in Table 3, samples of Nos. 1 to 13, which are the steels of the present invention, had a creep-rupture time of not less than 13,700 hours at 650° C. and an impact value of not less than 150 $J/cm^2$. It had a scale thickness of not more than 83 μm when oxidized by steam. From these results, it is confirmed that the steels of the present invention satisfy all the requirements of creep strength at elevated temperatures, toughness, and resistance to steam oxidation. Among the steel samples of the present invention, No. 1 represents the essential chemical composition, No. 2 represents the case where Ni and B are further contained, and Nos. 3 to 11 represent the cases where at least one element of at least one of the following three groups are added to the essential chemical composition.

Group I:

Ti: 0.005 to 0.15%,

Zr: 0.005 to 0.3%,

Hf: 0.005 to 0.60%,

Group 2:

Sc: 0.001 to 0.08%,

Y: 0.001 to 0.15%,

La: 0.001 to 0.23%, ce: 0.001 to 0.23%.

Group 3:

Ca, Mg: 0.0005 to 0.010%.

Samples of Nos. 12 and 13 both contained Nb, and satisfied the conditions of expressions (3) and (4).

As shown in Table 4. some of comparative samples Nos. 14 to 34 exhibited good values in creep-rupture time, impact value, or in the thickness of scale formed as a result of steam oxidation which are comparable to those of the steel of the present invention. However, no comparative samples satisfied all three requirements at the high level at the same time. Especially, conventional steel samples of Nos. 31 to 34 all had a creep-rupture time of less than 1,000 hours under conditions of 650° C. and 100 MPa. In addition, their creep strength at elevated temperatures is extremely low. The samples of No. 14 to No. 27, each of which had a chemical composition outside the range of the present invention, are inferior to the present invention in any one or all of the three properties. The chemical composition of Sample Nos. 28 and 29 fell in the range of the present invention except that they did not contain Nb. Moreover, the SEQ value defined in expression (2) is higher than the O (oxygen) content, and therefore, expression (1) was not satisfied. From these reasons, they had low impact values and large scale thickness due to steam oxidation. Sample No. 30, which contained Nd and Nb, had a chemical composition falling in the range of the present invention. However, it had a PNd value which does not satisfy expression (3). Therefore, it is inferior to the steel of the invention in any item of creep-rupture time, impact value, and the scale thickness.

As mentioned above, the steels of the present invention were demonstrated to have remarkably excellent creep strength at elevated temperatures, toughness, and resistance to steam oxidation compared to comparative steels and conventional steels.

Example 2:

In a manner similar to that described in Example 1. samples having chemical compositions shown in Tables 5 and 6 were manufactured.

TABLE 5

| Sample | CHEMICAL COMPOSITION (% by weight) | | | | | | | | | | | | | | | | | Other |
|---|---|---|---|---|---|---|---|---|---|---|---|---|---|---|---|---|---|---|
| No. | C | Si | Mn | P | S | Cr | W | Mo | Co | V | Ta | Nb | Nd | Hf | N | B | sol. Al | elements |
| 1 | 0.08 | 0.15 | 0.20 | 0.014 | 0.0004 | 10.20 | 3.12 | 0.01 | 4.33 | 0.21 | 0.04 | 0.07 | 0.05 | 0.005 | 0.044 | 0.0025 | 0.003 | |
| 2 | 0.10 | 0.20 | 0.21 | 0.015 | 0.0008 | 10.56 | 3.05 | 0.01 | 3.82 | 0.20 | 0.05 | 0.06 | 0.03 | 0.03 | 0.063 | 0.0033 | 0.005 | |
| 3 | 0.11 | 0.19 | 0.18 | 0.023 | 0.0012 | 10.38 | 2.94 | 0.01 | 3.16 | 0.24 | 0.07 | 0.07 | 0.06 | 0.01 | 0.058 | 0.0031 | 0.004 | |
| 4 | 0.09 | 0.25 | 0.22 | 0.021 | 0.0005 | 10.85 | 2.85 | 0.04 | 4.98 | 0.22 | 0.07 | 0.06 | 0.07 | 0.01 | 0.042 | 0.0028 | 0.006 | |
| 5 | 0.10 | 0.24 | 0.28 | 0.014 | 0.0002 | 11.24 | 3.15 | 0.01 | 5.04 | 0.28 | 0.06 | 0.05 | 0.03 | 0.02 | 0.055 | 0.0051 | 0.015 | |
| 6 | 0.10 | 0.24 | 0.25 | 0.011 | 0.0004 | 10.85 | 3.08 | 0.02 | 4.77 | 0.25 | 0.10 | 0.07 | 0.04 | 0.008 | 0.061 | 0.0054 | 0.009 | |
| 7 | 0.07 | 0.30 | 0.31 | 0.009 | 0.0003 | 10.54 | 3.22 | 0.05 | 3.96 | 0.22 | 0.11 | 0.08 | 0.05 | 0.01 | 0.039 | 0.0028 | 0.013 | |
| 8 | 0.11 | 0.24 | 0.30 | 0.021 | 0.0010 | 10.81 | 3.49 | 0.15 | 4.86 | 0.21 | 0.07 | 0.07 | 0.05 | 0.02 | 0.082 | 0.0038 | 0.004 | |
| 9 | 0.13 | 0.25 | 0.20 | 0.017 | 0.0011 | 10.25 | 3.01 | 0.03 | 5.11 | 0.19 | 0.06 | 0.07 | 0.02 | 0.03 | 0.025 | 0.0032 | 0.012 | Ni: 0.41 |
| 10 | 0.11 | 0.33 | 0.10 | 0.015 | 0.0005 | 10.11 | 3.77 | 0.04 | 4.82 | 0.31 | 0.14 | 0.06 | 0.01 | 0.05 | 0.112 | 0.0024 | 0.009 | Ni: 0.25 |
| 11 | 0.10 | 0.15 | 0.08 | 0.011 | 0.0006 | 9.85 | 3.14 | 0.01 | 3.31 | 0.25 | 0.07 | 0.08 | 0.03 | 0.03 | 0.054 | 0.0020 | 0.011 | |
| 12 | 0.10 | 0.41 | 0.02 | 0.010 | 0.0002 | 9.92 | 3.57 | 0.01 | 3.71 | 0.24 | 0.09 | 0.07 | 0.14 | 0.03 | 0.044 | 0.0021 | 0.003 | *2 |
| 13 | 0.11 | 0.30 | 0.21 | 0.007 | 0.0004 | 10.10 | 3.24 | 0.01 | 4.54 | 0.24 | 0.11 | 0.06 | 0.04 | 0.01 | 0.048 | 0.0026 | 0.010 | *3 |
| 14 | 0.10 | 0.28 | 0.45 | 0.001 | 0.0005 | 11.35 | 3.27 | 0.02 | 3.86 | 0.20 | 0.07 | 0.06 | 0.03 | 0.009 | 0.052 | 0.0031 | 0.011 | |
| 15 | 0.11 | 0.25 | 0.23 | 0.001 | 0.0004 | 9.03 | 3.09 | 0.15 | 4.03 | 0.21 | 0.08 | 0.07 | 0.20 | 0.01 | 0.037 | 0.0033 | 0.007 | |
| 16 | 0.12 | 0.30 | 0.68 | 0.001 | 0.0012 | 10.48 | 3.11 | 0.11 | 4.16 | 0.19 | 0.07 | 0.07 | 0.03 | 0.02 | 0.048 | 0.0023 | 0.012 | |
| 17 | 0.11 | 0.29 | 0.82 | 0.015 | 0.0006 | 9.36 | 3.40 | 0.04 | 4.75 | 0.20 | 0.12 | 0.06 | 0.01 | 0.04 | 0.050 | 0.0028 | 0.003 | |
| 18 | 0.10 | 0.05 | 0.21 | 0.014 | 0.0014 | 12.03 | 3.18 | 0.05 | 4.39 | 0.22 | 0.07 | 0.07 | 0.03 | 0.02 | 0.049 | 0.0021 | 0.011 | |
| 19 | 0.10 | 0.24 | 0.19 | 0.015 | 0.0007 | 12.25 | 3.03 | 0.01 | 4.51 | 0.21 | 0.05 | 0.04 | 0.04 | 0.13 | 0.052 | 0.0019 | 0.005 | |
| 20 | 0.10 | 0.28 | 0.20 | 0.016 | 0.0006 | 10.41 | 3.09 | 0.02 | 4.93 | 0.23 | 0.07 | 0.06 | 0.03 | 0.01 | 0.065 | 0.0075 | 0.004 | |
| 21 | 0.11 | 0.16 | 0.22 | 0.024 | 0.0006 | 10.89 | 3.11 | 0.01 | 4.27 | 0.24 | 0.06 | 0.11 | 0.04 | 0.03 | 0.055 | 0.0080 | 0.005 | |
| 22 | 0.11 | 0.41 | 0.19 | 0.016 | 0.0010 | 11.31 | 2.94 | 0.07 | 4,38 | 0.25 | 0.10 | 0.05 | 0.04 | — | 0.066 | 0.0025 | 0.003 | |
| 23 | 0.08 | 0.33 | 0.15 | 0.017 | 0.0008 | 10.77 | 3.12 | 0.05 | 4.33 | 0.21 | 0.06 | 0.07 | 0.04 | — | 0.062 | 0.0043 | 0.003 | |

*2: $P_{Nd}$ = Nd − 6.01 × 0(Oxygen)= 0.0901, $P_{Nb}$ = 0.151 × Nb + 0.0971 × $P_{Nd}$ = 0.0193
*3: $P_{Nd}$ = 0.0093, $P_{Nb}$ = 0.0099

TABLE 6

| Sample No. | CHEMICAL COMPOSITION (% by weight) | | | | | | | | | | | | | | | | | Other elements |
|---|---|---|---|---|---|---|---|---|---|---|---|---|---|---|---|---|---|---|
| | C | Si | Mn | P | S | Cr | W | Mo | Co | V | Ta | Nb | Nd | Hf | N | B | sol. Al | |
| 24 | 0.01* | 0.45 | 0.49 | 0.015 | 0.0008 | 9.13 | 2.92 | 0.05 | 3.56 | 0.20 | 0.04 | 0.05 | 0.05 | 0.03 | 0.051 | 0.0024 | 0.009 | |
| 25 | 0.17* | 0.39 | 0.52 | 0.017 | 0.0012 | 8.86 | 2.75 | 0.15 | 3.06 | 0.21 | 0.03 | 0.04 | 0.01 | 0.02 | 0.050 | 0.0018 | 0.007 | *4 |
| 26 | 0.09 | 1.22* | 0.82 | 0.025 | 0.0015 | 8.99 | 3.07 | 0.01 | 4.65 | 0.21 | 0.08 | 0.05 | 0.04 | 0.05 | 0.075 | 0.0052 | 0.007 | |
| 27 | 0.10 | 0.25 | 1.74* | 0.018 | 0.0005 | 11.34 | 2.83 | 0.06 | 3.25 | 0.24 | 0.05 | 0.07 | 0.03 | 0.05 | 0.051 | 0.0036 | 0.006 | |
| 28 | 0.10 | 0.29 | 0.88 | 0.045* | 0.0173* | 8.89 | 2.56 | 0.11 | 4.03 | 0.23 | 0.09 | 0.10 | 0.05 | 0.1 | 0.063 | 0.0081 | 0.005 | |
| 29 | 0.11 | 0.28 | 0.65 | 0.017 | 0.0012 | 7.26* | 2.68 | 0.04 | 4.11 | 0.26 | 0.03 | 0.07 | 0.05 | 0.04 | 0.055 | 0.0026 | 0.012 | |
| 30 | 0.10 | 0.29 | 0.50 | 0.012 | 0.0009 | 13.52* | 2.94 | 0.01 | 3.52 | 0.25 | 0.03 | 0.10 | 0.01 | 0.05 | 0.063 | 0.0018 | 0.009 | |
| 31 | 0.10 | 0.31 | 0.47 | 0.001 | 0.0012 | 9.44 | 3.02 | 0.58* | 3.05 | 0.26 | 0.09 | 0.05 | 0.01 | 0.03 | 0.055 | 0.0024 | 0.008 | *5 |
| 32 | 0.11 | 0.28 | 0.46 | 0.015 | 0.0009 | 9.23 | 2.05* | 0.02 | 3.55 | 0.21 | 0.07 | 0.06 | 0.05 | 0.04 | 0.053 | 0.0018 | 0.009 | |
| 33 | 0.10 | 0.29 | 0.44 | 0.015 | 0.0008 | 8.94 | 4.33* | 0.05 | 4.86 | 0.23 | 0.07 | 0.06 | 0.05 | 0.04 | 0.073 | 0.0085 | 0.011 | |
| 34 | 0.11 | 0.24 | 0.44 | 0.015 | 0.0010 | 8.89 | 3.20 | 0.05 | 1.25* | 0.21 | 0.11 | 0.05 | 0.03 | 0.05 | 0.055 | 0.0051 | 0.009 | |
| 35 | 0.10 | 0.28 | 0.53 | 0.015 | 0.0008 | 8.91 | 2.96 | 0.01 | 8.86 | 0.25 | 0.10 | 0.05 | 0.05 | 0.04 | 0.082 | 0.0047 | 0.010 | |
| 36 | 0.10 | 0.30 | 0.49 | 0.021 | 0.0014 | 8.85 | 2.88 | 0.05 | 4.83 | 0.02* | 0.07 | 0.05 | 0.04 | 0.03 | 0.054 | 0.0027 | 0.009 | |
| 37 | 0.10 | 0.27 | 0.44 | 0.016 | 0.0009 | 8.84 | 2.96 | 0.01 | 3.88 | 0.77* | 0.06 | 0.05 | 0.1 | 0.05 | 0.062 | 0.0033 | 0.010 | |
| 38 | 0.10 | 0.29 | 0.51 | 0.014 | 0.0008 | 8.95 | 2.77 | 0.05 | 3.54 | 0.25 | 0.05 | 0.21* | 0.05 | 0.04 | 0.071 | 0.0028 | 0.009 | |
| 39 | 0.10 | 0.33 | 0.34 | 0.015 | 0.0015 | 8.35 | 2.89 | 0.04 | 3.88 | 0.24 | 0.25* | 0.07 | 0.09 | 0.09 | 0.059 | 0.0018 | 0.011 | |

TABLE 6-continued

| Sample No. | CHEMICAL COMPOSITION (% by weight) | | | | | | | | | | | | | | | | | |
|---|---|---|---|---|---|---|---|---|---|---|---|---|---|---|---|---|---|---|
| | C | Si | Mn | P | S | Cr | W | Mo | Co | V | Ta | Nb | Nd | Hf | N | B | sol. Al | Other elements |
| 40 | 0.11 | 0.27 | 0.50 | 0.015 | 0.0014 | 8.85 | 3.06 | 0.12 | 3.45 | 0.23 | 0.07 | 0.06 | 0.08 | 0.28 | 0.053 | 0.0005 | 0.018 | |
| 41 | 0.10 | 0.25 | 0.49 | 0.014 | 0.0007 | 9.24 | 2.81 | 0.11 | 3.61 | 0.25 | 0.05 | 0.09 | 0.27* | 0.09 | 0.071 | 0.0012 | 0.013 | |
| 42 | 0.08 | 0.31 | 0.44 | 0.015 | 0.0005 | 9.04 | 3.00 | 0.05 | 3.95 | 0.24 | 0.05 | 0.05 | 0.05 | 0.1 | 0.055 | 0.0003 | 0.065 | |
| 43 | 0.09 | 0.30 | 0.82 | 0.018 | 0.0005 | 8.79 | 3.03 | 0.04 | 3.99 | 0.22 | 0.07 | 0.07 | 0.04 | 0.08 | 0.140 | 0.0009 | 0.014 | |
| 44 | 0.07 | 0.33 | 0.54 | 0.015 | 0.0009 | 9.01 | 2.96 | 0.04 | 3.92 | 0.21 | 0.10 | 0.06 | 0.09 | 0.11 | 0.059 | 0.031 | 0.008 | |
| 45 | 0.13 | 0.59 | 0.37 | 0.021 | 0.005 | 8.78 | —* | 1.01* | —* | —* | —* | —* | —* | — | 0.026 | — | 0.003 | Ni: 0.13 |
| 46 | 0.11 | 0.42 | 0.39 | 0.014 | 0.003 | 8.42 | —* | 0.95 | —* | 0.21 | —* | 0.07 | —* | — | 0.051 | — | 0.012 | Ni: 0.06 |

*Outside the range of the invention

*4: $P_{Nd}$ = Nd− 6.01 × 0(Oxygen) = −0.0243, $P_{Nb}$ = 0.151 × Nb + 0.0971 × $P_{Nd}$ = 0.0037

*5: $P_{Nd}$ = −0.3626, $P_{Nb}$ = −0.0277

Table 5 shows the chemical compositions of the steels of the present invention, and Table 6 shows the chemical compositions of conventional steels and comparative steels. Conventional steel samples of No. 45 and No. 46 were normalized at 950° C. for 1 hour and subsequently cooled in air, and further tempered at 750° C. for 1 hour and subsequently cooled in air. Other samples had taken a normalizing treatment in which they were retained at 1050° C. for 1 hour and cooled in air, and a tempering treatment in which they were retained at 780° C. for 1 hour and cooled in air.

From these samples, test pieces for evaluating creep strength at elevated temperatures and toughness of the base metal and welded joints were prepared. Test pieces of welded joints were made as follows. A sample in the plate form was partly machined to have a groove of 60°, which was welded to make a welded joint using a welding material. The first layer was made by a TIG welding, and the second and subsequent layers were made by manual welding. The test pieces were subjected to post weld heat treatment which was carried out at 740° C. for 2 hours and subsequently cooled in furnace. Samples of welded joints for creep-rupture testing and impact testing were prepared from the sites of the base metal and the welded joint. Samples of Nos. 45 and 46 in Table 6 were conventional 9% Cr ferritic heat-resistant steels, which are described in JIS STBA26 and ASTM A213 T91, respectively.

The test methods and test conditions for evaluating creep-rupture at elevated temperatures and toughness are the same as those described in Example 1, except that the stress applied in the creep-rupture test was 98 MPa.

The results of these test are shown in Tables 7 and 8.

TABLE 7

| Sample No. | Creep-rupture time (hr) | | | Impact value: $vE_0$ (J/cm$^2$) | | |
|---|---|---|---|---|---|---|
| | Base metal (a) | Welded joint (b) | b/a | Base meta (a) | Welded joint (b) | b/a |
| 1 | 15541 | 15423 | 0.99 | 128 | 110 | 0.86 |
| 2 | 15723 | 15037 | 0.96 | 141 | 139 | 0.99 |
| 3 | 15341 | 13865 | 0.90 | 143 | 138 | 0.97 |
| 4 | 15063 | 14958 | 0.99 | 159 | 150 | 0.94 |
| 5 | 15193 | 15034 | 0.99 | 192 | 178 | 0.93 |
| 6 | 15496 | 14880 | 0.96 | 188 | 171 | 0.91 |
| 7 | 14980 | 14759 | 0.99 | 179 | 170 | 0.95 |
| 8 | 15012 | 14751 | 0.98 | 165 | 158 | 0.96 |
| 9 | 14785 | 14463 | 0.98 | 173 | 169 | 0.98 |
| 10 | 15583 | 14859 | 0.95 | 186 | 177 | 0.95 |
| 11 | 15034 | 14320 | 0.95 | 191 | 180 | 0.94 |
| 12 | 15131 | 14586 | 0.96 | 184 | 173 | 0.94 |
| 13 | 14951 | 14118 | 0.94 | 190 | 170 | 0.89 |

TABLE 7-continued

| Sample No. | Creep-rupture time (hr) | | | Impact value: $vE_0$ (J/cm$^2$) | | |
|---|---|---|---|---|---|---|
| | Base metal (a) | Welded joint (b) | b/a | Base meta (a) | Welded joint (b) | b/a |
| 14 | 16038 | 15043 | 0.94 | 195 | 180 | 0.92 |
| 15 | 15031 | 14888 | 0.99 | 172 | 166 | 0.97 |
| 16 | 15036 | 14195 | 0.94 | 175 | 165 | 0.94 |
| 17 | 14956 | 14002 | 0.94 | 138 | 132 | 0.96 |
| 18 | 15033 | 14464 | 0.96 | 165 | 158 | 0.96 |
| 19 | 14608 | 14053 | 0.96 | 192 | 188 | 0.98 |
| 20 | 15107 | 14499 | 0.96 | 156 | 151 | 0.97 |
| 21 | 15294 | 14593 | 0.95 | 180 | 176 | 0.98 |
| 22 | 14836 | 14503 | 0.98 | 172 | 166 | 0.97 |
| 23 | 14429 | 14029 | 0.97 | 169 | 161 | 0.95 |

TABLE 8

| Sample No. | Creep-rupture time (hr) | | | Impact value: $vE_0$ (J/cm$^2$) | | |
|---|---|---|---|---|---|---|
| | Base metal (a) | Welded joint (b) | b/a | Base meta (a) | Welded joint (b) | b/a |
| 24 | 743 | 661 | 0.89 | 110 | 100 | 0.91 |
| 25 | 6139 | 3644 | 0.59 | 32 | 11 | 0.34 |
| 26 | 8531 | 5529 | 0.65 | 26 | 9 | 0.35 |
| 27 | 7493 | 6012 | 0.80 | 35 | 21 | 0.60 |
| 28 | 4372 | 3149 | 0.72 | 41 | 36 | 0.88 |
| 29 | 9136 | 6502 | 0.71 | 151 | 130 | 0.86 |
| 30 | 14385 | 7541 | 0.52 | 54 | 31 | 0.57 |
| 31 | 10371 | 6653 | 0.64 | 114 | 86 | 0.75 |
| 32 | 3210 | 2871 | 0.89 | 173 | 166 | 0.96 |
| 33 | 15016 | 7351 | 0.49 | 32 | 13 | 0.41 |
| 34 | 3169 | 2231 | 0.70 | 53 | 41 | 0.77 |
| 35 | 8315 | 6582 | 0.79 | 109 | 76 | 0.70 |
| 36 | 2184 | 1847 | 0.85 | 132 | 111 | 0.84 |
| 37 | 5197 | 3271 | 0.63 | 27 | 16 | 0.59 |
| 38 | 7430 | 5834 | 0.79 | 33 | 21 | 0.64 |
| 39 | 6438 | 5831 | 0.91 | 22 | 13 | 0.59 |
| 40 | 9859 | 7284 | 0.74 | 35 | 21 | 0.60 |
| 41 | 7541 | 7016 | 0.93 | 43 | 30 | 0.70 |
| 42 | 6431 | 5310 | 0.83 | 51 | 17 | 0.33 |
| 43 | 5835 | 4187 | 0.72 | 14 | 12 | 0.86 |
| 44 | 8473 | 4310 | 0.51 | 87 | 16 | 0.18 |
| 45 | 10 | 7 | 0.70 | 101 | 63 | 0.62 |
| 46 | 18 | 16 | 0.89 | 174 | 98 | 0.56 |

The Table 7 data are obtained from sample steels of the present invention, and Table 8 data are obtained from the comparative steels and conventional steels.

As shown in Table 7, sample steel Nos. 1 to 23 of the present invention exhibited a creep-rupture time at 650° C. of not less than 13,800 hours in both base metal and welded joints and an impact value of not less than 110 J/cm$^2$ in both of base metal and welded joints. Thus, any of the sample steels of the present invention had excellent properties. The ratio in creep time of welded joint to base metal was not less than 0.86, and the same ratio in impact value was not less than 0.90. Thus, the creep-rupture strength at elevated temperatures and toughness of welded joints were comparable to those of the base metal.

On the other hand, as shown in Table 8, some of comparative sample Nos. 24 to 46 exhibited high values in creep time or in impact value, which are comparable to the steels of the present invention. However, no comparative samples satisfied the two property requirements at the same time in both base metal and welded joint. Especially, even when the base metal had excellent properties, welded joints had poor properties. Conventional steel samples of Nos, 45 and 46 had a considerably low creep strength at elevated temperatures, exhibiting a creep time of less than 20 hours under conditions of 650° C. and 100 MPa. PNd and PNb values of sample Nos. 12 and 13 (steels of the present invention) and sample Nos. 25 and 31 (comparative steels) are shown in Tables 5 and 6. The PNd and PNb values of the comparative steels do not satisfy the conditions of expressions (3) and (4). The poor results in creep time and impact values of the above two comparative steels may be explained by improper $P_{Nd}$ and $P_{Nb}$ values. Thus, if both Nd and Nb are contained, it is preferred that expressions (3) and (4) be satisfied.

As described above, it was demonstrated that the steels of the present invention in Example 2 had excellent creep strength at elevated temperatures and excellent toughness in both the base metal and welded joints compared with comparative steels and conventional steels.

As set forth herein above, the high chromium ferritic heat-resistant steel of the present invention has remarkable properties in that the base metal and welded joints of the steel both exhibit excellent long term creep strength at elevated temperatures over 600° C., excellent resistance to steam oxidation, and excellent toughness at room temperatures. Therefore, they can be advantageously used as a material for boilers, nuclear power plants, and chemical engineering facilities, which are operated under conditions of high temperature and high pressure. For example, they can be used for making steel tubes for heat exchanger, steel plates for pressure vessels, and turbine parts.

What is claimed is:

1. A high chromium ferritic heat-resistant steel showing excellent long term creep strength at elevated temperatures, excellent resistance to steam oxidation and excellent toughness, which has the following chemical composition:

| | |
|---|---|
| C: 0.02 to 0.15%, | Si: 0 to 1.0%, |
| Mn: 0.05 to 1.5%, | Ni: 0 to 1.5%, |
| Cr: 8.0 to 13.0%, | W: 1.5 to 4.0%, |
| Mo: 0 to 1.0%, | Co: 2.5 to 8.0%, |
| V: 0.10 to 0.50%, | Ta: 0.01 to 0.50%, |
| Nb: 0 to 0.15%, | Nd: 0.001 to 0.24%, |
| Ca: 0 to 0.010%, | Mg: 0 to 0.010%, |
| N: 0.020 to 0.12%, | B: 0 to 0.030%, |
| sol. Al: 0.001 to 0.050%, | and |

balance: Fe and incidental imputities, wherein % means % by weight.

2. The high chromium ferritic heat-resistant steel showing excellent long term creep strength at elevated temperatures and excellent toughness in a welded joint as well as the base metal according to claim 1, wherein W, Mo, Ta, Nb, and B are contained in the following amounts:

| | | | |
|---|---|---|---|
| W: | 2.5 to 4.5%, | Mo: | 0 to 0.2%, |
| Ta: | 0.01 to 0.20%, | Nb: | 0.01 to 0.15%, |
| B: | 0 to 0.020%, | | |

wherein means % by weight.

3. The high chromium ferritic heat-resistant steel according to claim 1, which contains not more than 0.010% of oxygen and which satisfies the following expressions (3) and (4):

$$0 \leqq P_{Nd} \leqq 0.103 \quad (3)$$

$$0.005 \leqq P_{Nb} \leqq 0.03 \quad (4)$$

wherein $$P_{Nd} = Nd - 6.01 \times O \text{ (oxygen)} \quad (5)$$

and $$P_{Nb} = 0.151 \times Nb + 0.0971 \times P_{Nd} \quad (6)$$

wherein each element symbol represents the content (% by eight) of the element.

4. The high chromium ferritic heat-resistant steel according to claim 2, which contains not more than 0.010% of oxygen and which satisfies the following expressions (3) and (4):

$$0 \leqq P_{Nd} \leqq 0.103 \quad (3)$$

$$0.005 \leqq P_{Nb} \leqq 0.03 \quad (4)$$

wherein $$P_{Nd} = Nd - 6.01 \times O \text{ (oxygen)} \quad (5)$$

and $$P_{Nb} = 0.151 \times Nb + 0.0971 \times P_{Nd} \quad (6)$$

wherein each element symbol represents the content (% by weight) of the element.

5. A high chromium ferritic heat-resistant steel showing excellent long term creep strength at elevated temperatures, excellent resistance to steam oxidation and excellent toughness, which has the following chemical composition and which satisfies following expression (1):

| | |
|---|---|
| C: 0.02 to 0.15%, | Si: 0 to 1.0%, |
| Mn: 0.05 to 1.5%, | Ni: 0 to 1.5%, |
| Cr: 8.0 to 13.0%, | W: 1.5 to 4.0%, |
| Mo: 0 to 1.0%, | Co: 2.5 to 8.0%, |
| V: 0.10 to 0.50%, | Ta: 0.01 to 0.50%, |
| Nb: 0 to 0.15%, | Nd: 0.001 to 0.24%, |
| Ca: 0 to 0.010%, | Mg: 0 to 0.010%, |
| N: 0.020 to 0.12%, | B: 0 to 0.030%, |
| sol. Al: 0.001 to 0.050%, and | |

at least one element of Sc, Y, La, and Ce in the following amounts:

| | |
|---|---|
| Sc: 0.001 to 0.08%, | Y: 0.001 to 0.15%, |
| La: 0.001 to 0.23%, | Ce: 0.001 to 0.23%, |
| balance: Fe and incidental impurities, | |

wherein % means % by weight;

$$O\ (oxygen) \leqq SEQ \leqq 0.060 \quad (1)$$

wherein $$SEQ = 48.0 \times (Nd/288.40 + Sc/89.91 + Y/177.92 + La/277.81 + Ce/280.24) \quad (2)$$

wherein each element symbol represents the content (% by weight) of the element.

6. The high chromium ferritic heat-resistant steel showing excellent long term creep strength at elevated temperatures and excellent toughness in a welded joint as well as the base metal according to claim 5, wherein W, Mo, Ta, Nb, and B are contained in the following amounts:

| | |
|---|---|
| W: 2.5 to 4.5%, | Mo: 0 to 0.2%, |
| Ta: 0.01 to 0.20%, | Nb: 0.01 to 0.15%, |
| B: 0 to 0.020%, | |

wherein means % by weight.

7. The high chromium ferritic heat-resistant steel according to claim 5, which contains not more than 0.010% of oxygen and which satisfies the following expressions (3) and (4):

| | | |
|---|---|---|
| | $0 \leqq P_{Nd} \leqq 0.103$ | (3) |
| | $0.005 \leqq P_{Nb} \leqq 0.03$ | (4) |
| wherein | $P_{Nd} = Nd - 6.01 \times 0$ (oxygen) | (5) and |
| | $P_{Nb} = 0.151 \times Nb + 0.0971 \times P_{Nd}$ | (6) |

wherein each element symbol represents the content (% by weight) of the element.

8. The high chromium ferritic heat-resistant steel according to claim 6, which contains not more than 0.010% of oxygen and which satisfies the following expressions (3) and (4):

| | | |
|---|---|---|
| | $0 \leqq P_{Nd} \leqq 0.103$ | (3) |
| | $0.005 \leqq P_{Nb} \leqq 0.03$ | (4) |
| wherein | $P_{Nd} = Nd - 6.01 \times 0$ (oxygen) | (5) and |
| | $P_{Nb} = 0.151 \times Nb + 0.0971 \times P_{Nd}$ | (6) |

wherein each element symbol represents the content (% by weight) of the element.

9. A high chromium ferritic heat-resistant steel showing excellent long term creep strength at elevated temperatures, excellent resistance to steam oxidation and excellent toughness, which has the following chemical composition:

| | |
|---|---|
| C: 0.02 to 0.15%, | Si: 0 to 1.0%, |
| Mn: 0.05 to 1.5%, | Ni: 0 to 1.5%, |
| Cr: 8.0 to 13.0%, | W: 1.5 to 4.0%, |
| Mo: 0 to 1.0%, | Co: 2.5 to 8.0%, |
| V: 0.10 to 0.50%, | Ta: 0.01 to 0.50%, |
| Nb: 0 to 0.15%, | Nd: 0.001 to 0.24%, |
| Ca: 0 to 0.010%, | Mg: 0 to 0.010%, |
| N: 0.020 to 0.12%, | B: 0 to 0.030%, |
| sol. Al: 0.001 to 0.050%, and | |

at least one element of Hf, Ti, and Zr in the following amounts:

| | |
|---|---|
| Hf: 0.005 to 0.60%, | Ti: 0.005 to 0.15%, |
| Zr: 0.005 to 0.30%, | |

balance: FE, and incidental impurities,
wherein % means % by weight.

10. The high chromium ferritic heat-resistant steel showing excellent long term creep strength at elevated temperatures and excellent toughness in a welded joint as well as the base metal according to claim 9, wherein W, Mo, Ta, Nb, B and Hf are contained in the following amounts:

| | |
|---|---|
| W: 2.5 to 4.5%, | Mo: 0 to 0.2%, |
| Ta: 0.01 to 0.20%, | Nb: 0.01 to 0.15%, |
| B: 0 to 0.020%, | Hf: 0.001 to 0.20%, |

wherein means % by weight.

11. The high chromium ferritic heat-resistant steel according to claim 9, which contains not more than 0.010% of oxygen and which satisfies the following expressions (3) and (4):

| | | |
|---|---|---|
| | $0 \leqq P_{Nd} \leqq 0.103$ | (3) |
| | $0.005 \leqq P_{Nb} \leqq 0.03$ | (4) |
| wherein | $P_{Nd} = Nd - 6.01 \times 0$ (oxygen) | (5) and |
| | $P_{Nb} = 0.151 \times Nb + 0.0971 \times P_{Nd}$ | (6) |

wherein each element symbol represents the content (% by weight) of the element.

12. The high chromium ferritic heat-resistant steel according to claim 10, which contains not more than 0.010% of oxygen and which satisfies the following expressions (3) and (4):

| | | |
|---|---|---|
| | $0 \leqq P_{Nd} \leqq 0.103$ | (3) |
| | $0.005 \leqq P_{Nb} \leqq 0.03$ | (4) |
| wherein | $P_{Nd} = Nd - 6.01 \times 0$ (oxygen) | (5) and |
| | $P_{Nb} = 0.151 \times Nb + 0.0971 \times P_{Nd}$ | (6) |

wherein each element symbol represents the content (% by weight) of the element.

13. A high chromium ferritic heat-resistant steel showing excellent long term creep strength at elevated temperatures, excellent resistance to steam oxidation and excellent toughness, which has the following chemical composition and which satisfies following expression (1):

| | |
|---|---|
| C: 0.02 to 0.15%, | Si: 0 to 1.0%, |
| Mn: 0.05 to 1.5%, | Ni: 0 to 1.5%, |
| Cr: 8.0 to 13.0%, | W: 1.5 to 4.0%, |
| Mo: 0 to 1.0%, | Co: 2.5 to 8.0%, |
| V: 0.10 to 0.50%, | Ta: 0.01 to 0.50%, |
| Nb: 0 to 0.15%, | Nd: 0.001 to 0.24%, |
| Ca: 0 to 0.010%, | Mg: 0 to 0.010%, |
| N: 0.020 to 0.12%, | B: 0 to 0.030%, |
| sol. Al: 0.001 to 0.050%, | |

at least one element of Sc, Y, La, and Ce in the following amounts:

| | |
|---|---|
| Sc: 0.001 to 0.08%, | Y: 0.001 to 0.15%, |
| La: 0.001 to 0.23%, | Ce: 0.001 to 0.23%, |

at least one element of Hr, Ti, and Zr in the following amounts:

| | |
|---|---|
| Hf: 0.005 to 0.60%, | Ti: 0.005 to 0.15%, |
| Zr: 0.005 to 0.30%, and | |

balance: Fe and incidental impurities,
wherein % means % by weight:

$$O\ (oxygen) \leqq SEQ \leqq 0.060 \quad (1)$$

wherein $$SEQ = 48.0 \times (Nd/288.40 + Sc/89.91 + Y/177.92 + La/277.81 + Ce/280.24) \quad (2)$$

wherein each element symbol represents the content (% by weight) of the element.

14. The high chromium ferritic heat-resistant steel showing excellent long term creep strength at elevated temperatures and excellent toughness in a welded joint as well as the base metal according to claim 13, wherein W, Mo, Ta, Nb, B and Hf are contained in the following amounts:

| | |
|---|---|
| W: 2.5 to 4.5%, | Mo: 0 to 0.2%, |
| Ta: 0.01 to 0.20%, | Nb: 0.01 to 0.15%, |
| B: 0 to 0.020%, | Hf: 0.001 to 0.20%, |

wherein % means % by weight.

15. The high chromium ferritic heat-resistant steel according to claim 13, which contains not more than 0.010% of oxygen and which satisfies the following expressions (3) and (4):

$$0 \leqq P_{Nd} \leqq 0.103 \quad (3)$$
$$0.005 \leqq P_{Nb} \leqq 0.03 \quad (4)$$

wherein $$P_{Nd} = Nd - 6.01 \times 0 \text{ (oxygen)} \quad (5) \text{ and}$$
$$P_{Nb} = 0.151 \times Nb + 0.0971 \times P_{Nd} \quad (6)$$

wherein each element symbol represents the content (% by weight) of the element.

16. The high chromium ferritic heat-resistant steel according to claim 14, which contains not more than 0.010% of oxygen and which satisfies the following expressions (3) and (4):

$$0 \leqq P_{Nd} \leqq 0.103 \quad (3)$$
$$0.005 \leqq P_{Nb} \leqq 0.03 \quad (4)$$

wherein $$P_{Nd} = Nd - 6.01 \times O \text{ (oxygen)} \quad (5)$$

and $$P_{Nb} = 0.151 \times Nb + 0.0971 \times P_{Nd} \quad (6)$$

wherein each element symbol represents the content (% by weight) of the element.

* * * * *